United States Patent [19]

Clinton

[11] 4,132,383

[45] Jan. 2, 1979

[54] SAFETY VALVE CONTROL SYSTEM FOR PRODUCTION WELL

[75] Inventor: Edward R. Clinton, Anchorage, Ak.

[73] Assignee: Dowland-Bach Corporation, Anchorage, Ak.

[21] Appl. No.: 850,817

[22] Filed: Nov. 11, 1977

Related U.S. Application Data

[62] Division of Ser. No. 682,040, Apr. 30, 1976, Pat. No. 4,062,379.

[51] Int. Cl.[2] ..... F16K 31/12

[52] U.S. Cl. ..... 251/29

[58] Field of Search ..... 137/565; 166/53; 251/28, 29

[56] References Cited

U.S. PATENT DOCUMENTS

| | | | |
|---|---|---|---|
| 2,308,187 | 1/1943 | MacLean et al. | 251/28 X |
| 2,536,184 | 1/1951 | Johnson | 251/29 X |
| 3,053,188 | 9/1962 | Dinning et al. | 251/29 X |
| 3,185,344 | 5/1965 | Kenney | 251/29 X |
| 3,396,793 | 8/1968 | Piper et al. | 166/53 |
| 3,856,037 | 12/1974 | Garrett et al. | 166/53 X |

*Primary Examiner*—William R. Cline

*Attorney, Agent, or Firm*—Spencer & Kaye

[57] ABSTRACT

In a safety system for controlling the closing of a primary valve in response to an indication of an undesirable condition from a monitoring device, the system including a valve arrangement which supplies operating fluid to the primary valve and an operator connected between the monitoring device and the valve arrangement for controlling the operation of the latter in response to the indication produced by the monitoring device, the speed and reliability of the system is improved by providing a direct fluid connection between the output of the monitoring device and the operator, whereby the system is directly controlled by the fluid pressure variations at the output of the monitoring device. Preferably, the system includes an hydraulic subsystem and a pneumatic subsystem.

1 Claim, 1 Drawing Figure

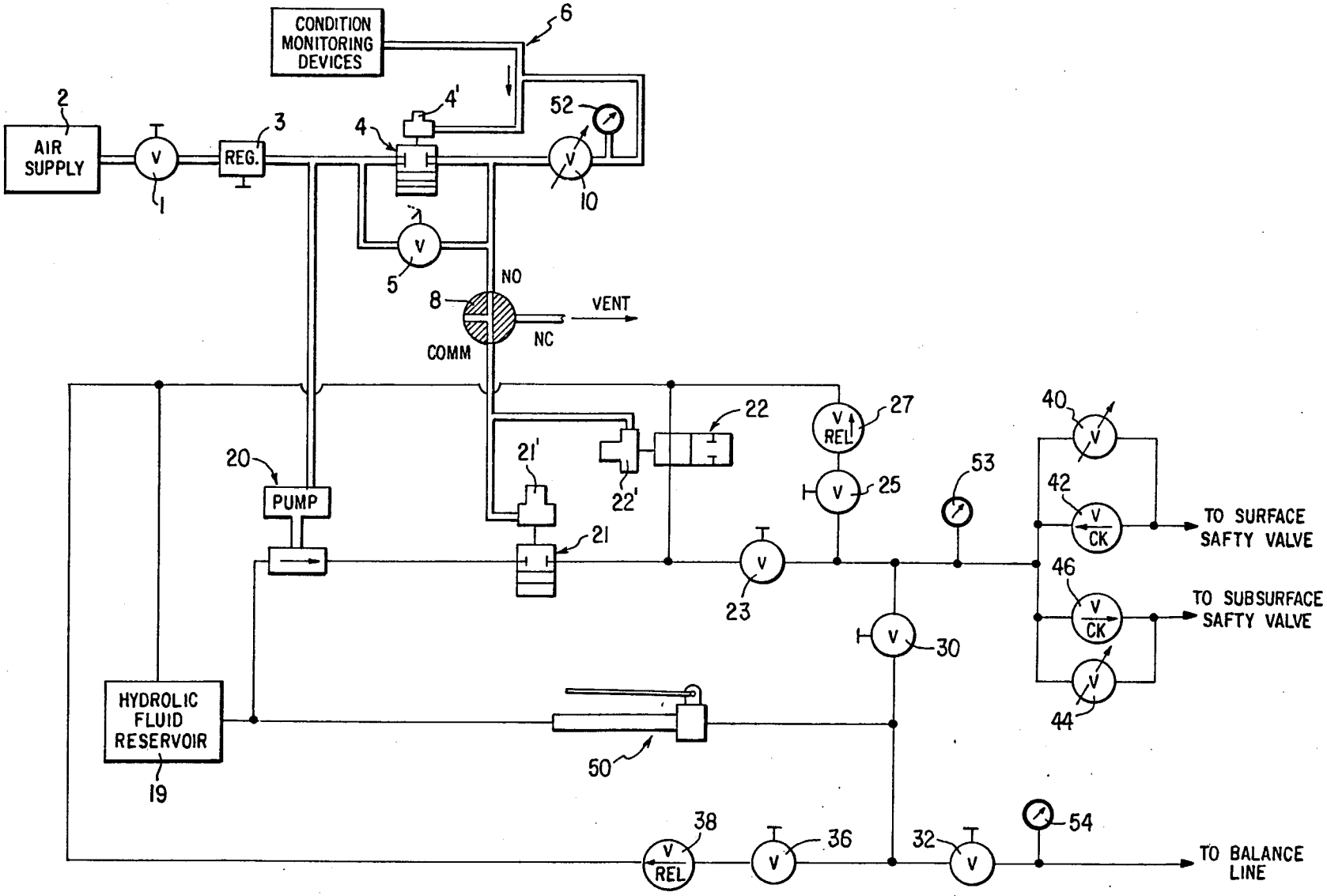
TO SURFACE SAFTY VALVE
TO SUBSURFACE SAFTY VALVE
TO BALANCE LINE
CONDITION MONITORING DEVICES
AIR SUPPLY
REG.
PUMP
HYDROLIC FLUID RESERVOIR
VENT
NO
NC
COMM
CK
REL
1
2
3
4
4'
5
6
7
8
10
19
20
21
21'
22
22'
23
25
27
30
32
36
38
40
42
44
46
50
52
53
54

SAFETY VALVE CONTROL SYSTEM FOR PRODUCTION WELL

CROSS-REFERENCE TO RELATED APPLICATION

This application is a division of application Ser. No. 682,040, filed Apr. 30, 1976, now U.S. Pat. No. 4,062,379.

BACKGROUND OF THE INVENTION

The present invention relates to a manifold system for controlling the operation of safety control valves, particularly in production wells for petroleum products.

In the course of operation of a production well via which a product such as gas or oil is being extracted from an underground deposit and delivered to a pipeline connected to the wellhead and located at or just below the ground surface, there are occasions when it is necessary to halt the flow of the product. Such an operation may be necessary, for example, to permit routine maintenance operations or to prevent spills in the event of an accident or equipment breakdown.

As a result, it has long been the practice in the industry to place at least one shut-off valve in the product flow path, such valve being conventionally located at the wellhead, i.e., essentially at the ground surface. However, location of a shut-off, or safety, valve essentially at the ground surface presents certain drawbacks, particularly since certain types of accidents could damage, or destroy, a valve at that location, in which event the valve could no longer act to block the flow of production fluid.

Therefore, it has more recently become the practice to insert a subsurface shut-off, or safety, valve in the well tubing which conducts the production fluid to the wellhead. Such subsurface valve can be disposed at any depth below the ground surface and is provided with an operating unit connected to systems located at the surface to effect remote control opening and closing of the valve.

The choice of depth for the location of such a subsurface valve is based on a number of considerations, including the depth to which a foreseeable accident occurring at ground level could damage such a valve, external conditions relating, for example, to the climate in which the well is located, and legal requirements. Consideration must also be given to the fact that the cost of installing, servicing, or replacing such a valve increases as a function of the depth at which the valve is to be located.

For example, in the case of a production well located in the North Slope of Alaska, where the permafrost layer extends to depths in excess of 2,000 feet, both State and Federal laws require that the subsurface safety valve, which is ordinarily a ball valve, be located below the permafrost level, and thus at a depth in excess of 2,000 feet. Since repair or replacement of a valve located at such a depth can be expected to be enormously expensive, particularly in the Arctic where, in view of the severe weather conditions, such replacement could conceivably cost $1,000,000 or more, it is important that steps be taken to avoid the need for servicing or replacing the subsurface valve.

For these reasons, it is desirable to dispose in the product flow path two valves, one located at the required level below the surface and one located at the surface, and to operate the valves in sequence in a manner to prevent the subsurface valve from opening or closing against high dynamic pressure loads or high flow rates.

In order to block the flow of production fluid from such a well in the event of an accident, it is a general practice to provide monitoring equipment which senses certain conditions, such as the pressure or rate of flow of product at the wellhead, the temperature of the environment surrounding the wellhead, etc., and to connect this monitoring equipment to effect closing of the safety valve, or valves, upon the occurrence of a condition indicating that an accident or malfunction has taken place. Of course, when such a condition is sensed, it is desirable that the safety valve, or valves, close as rapidly as possible.

In many cases, it is also desirable that the response of the system to an unsafe condition indication, or the sensitivity of the system be adjustable to compensate for changes in external conditions which can influence the operation of the system, or for unavoidable changes in the operating characteristics of various components of the system. It may also be desirable to be able to vary the speed of response of the system to an indication of an unsafe condition if, for example, external factors make it undesirable to close the safety valve, or valves, in the shortest time that the capabilities of the system permit.

On the other hand, it is equally desirable that the system which acts to close the valve, or valves, in response to the indication of an unsafe condition be as simple as possible since the reliability of any system is directly related to its structural simplicity.

SUMMARY OF THE INVENTION

It is a primary object of the present invention to improve both the reliability and operating speed capability of such a system.

A further object of the invention is to improve the operating flexibility of such a system by permitting its response speed to be adjustable over a substantial range and by permitting its sensitivity to be adjusted to compensate for changes in external conditions.

Another object of the invention is to permit the response speed and sensitivity of such a system to be adjusted in a rapid and simple manner.

A further object of the invention is to provide a system of this type which is structurally quite simple.

These and other objects according to the invention are achieved, in a system for closing a primary valve disposed in in the flow path of a primary fluid, in response to an indication of an undesirable condition from a monitoring device, the opening and closing of the primary valve being controlled by the pressure of an operating fluid supplied thereto, and the system being composed of input means arranged to be connected to the monitoring device to receive therefrom an indication of the condition being monitored, output means arranged to supply operating fluid to the primary valve, valve means connected with the output means for controlling the pressure of the operating fluid at the output means, and fluid-responsive operator means having an input operatively associated with the input means for receiving a control fluid, the operator means being connected to the valve means for switching the valve means between a state which causes the pressure at the output to effectuate opening of the primary valve and a state which causes the pressure at the output to effectuate closing of the primary valve, and the pressure of the control fluid at the operator means when an indication of an undesirable condition is present at the input means having a value which causes the operator means to switch the valve means into the state which causes the operating fluid pressure at the output means to effectuate closing of the primary valve, by the improvements involving providing the system with a conduit which is connected to establish direct fluid communication between the operator means input and the input means, such that control fluid is present at the input means, by arranging the system so that the control fluid pressure at the input means is determined by the indication received from the monitoring device, and by arranging the operator means to switch the valve means into the state which results in closing of the primary valve when the control fluid pressure at the operator means input corresponds to the control fluid pressure created at the input means when an indication of an undesirable condition is received from the monitoring device.

The objects according to the present invention are further achieved by providing an adjustable metering valve in series in the conduit means.

The objects according to the invention are further achieved by providing a pump which is driven by the control fluid and which constitutes a source of pressurized operating fluid, the operating fluid output pressure produced by the pump being proportional to the control fluid input pressure thereto, and by causing the operating pressure to at least a portion of the operator means to be proportional to the control fluid pressure supplied to the pump so that the force supplied by such operator means to the associated valve means will remain substantially proportional to the operating fluid pressure produced by the pump.

BRIEF DESCRIPTION OF THE DRAWING

The single FIGURE is a schematic diagram of a preferred embodiment of a safety control valve system according to the present invention.

DESCRIPTION OF THE PREFERRED EMBODIMENTS

The FIGURE illustrates a system according to the present invention having a pneumatic signal input 6 connected to any suitable condition monitoring devices, the choice of which depends on the particular characteristics and operating conditions of the wells to be controlled. One typical monitoring device is a pilot valve disposed to monitor the pressure in a section of pipeline conducting fluid away from the valve and to produce an unsafe condition indication if the pressure should decrease below a selected value. It is also known to provide pilot valves which produce an indication if the pressure in the pipeline exceeds a selected value. Other monitoring devices, such as temperature sensors, can also be connected to the manifold, at the point of connection 6.

The illustrated manifold is intended to control one or more production wells of the type provided with a surface safety valve, a subsurface safety valve and a balance line.

The surface safety valve is usually the upper master valve provided on the Christmas tree located at the wellhead. This valve is a hydraulically operated valve which opens when the pressure supplied thereto exceeds a predetermined value and closes when the hydraulic pressure drops below a predetermined value. Similarly, the subsurface safety valve, which is normally a ball valve, is controlled to open when the pressure of the hydraulic control fluid supplied thereto exceeds a selected value and to close when the pressure of that fluid drops below a selected value.

According to standard field practice, these valves are operated in a sequence which assures that opening of the subsurface valve will not occur against the full well pressure differential and that closing of the subsurface valve will not be effected against a full flow of production fluid. As a result the useful life and reliability of the subsurface valve will be increased. Thus, in accordance with standard practice, flow from the well will be initiated by first opening the subsurface valve and subsequently opening the surface valve, whereas shut-down will be effected by first closing the surface valve and subsequently closing the subsurface valve.

The delivery of hydraulic control fluid to the subsurface valve could be effected via a stainless steel line which runs down the well along the production tubing to the subsurface ball valve. Since the subsurface valve is disposed below ground level, the volume of hydraulic fluid in the control line will produce a certain pressure head and the greater the depth at which the subsurface valve is located, the higher will be the fluid head pressure at the operating unit of the subsurface valve. In order to prevent this static pressure head from adversely affecting the operation of the subsurface valve, a second stainless steel line is run, parallel to the first line, to the operating unit of the subsurface valve. This second line is referred to as a balance line and serves to provide a second pressure head which balances or compensates for the static pressure in the control line. Typically, the hydraulic pressure applied, at the surface, to the balance line is of the order of 20 to 100 psi.

The manifold illustrated in the FIGURE is thus provided with separate hydraulic outlets for connection to, respectively, the control input of the surface safety valve, the control input of the subsurface safety valve, and the input end of the balance line.

It will be seen from the above that a well control manifold system according to the invention is composed of a pneumatic subsystem and a hydraulic subsystem. The pneumatic paths are illustrated in the FIGURE by double lines representing air conduits, while the hydraulic paths are illustrated by single lines to be distinct from the pneumatic lines.

The pneumatic subsystem constitutes the input and control signal generating portion and the hydraulic subsystem controls the supply of operating fluid to the various lines associated with the well and is in turn controlled by the pneumatic subsystem.

The pneumatic subsystem includes a manually operable valve 1 connected to a source 2 of air under pressure which supplies the air for operating this subsystem. Connected to valve 1 is an air regulator 3 which is adjusted to supply a controlled quantity of air to the system.

Connected to regulator 3 is a parallel arrangement of a normally closed air operated valve 4 and a spring-biassed, manually operable, normally closed toggle valve 5.

The operator portion 4' of valve 4 is connected to a pneumatic signal input 6 to receive a pneumatic control signal from any condition monitors provided to effect closing of the well upon the occurrence of particular conditions. The operator part 4' of valve 4 is also connected to the other side of the flow path defined by that valve and to the other side of valve 5, as well as to the normally open port of a manually-operated three-way valve 8, via an accurately adjustable metering valve 10 providing a passage of variable diameter. Valve 8 may be a ball valve.

Air regulator 3 is also connected to deliver driving air to air-driven hydraulic fluid pump 20.

The common port of three-way valve 8 is connected to the operators 21' and 22' of air operated hydraulic fluid control valves 21 and 22. Valve 21 is normally closed while valve 22 is normally open, these being the states which they assume when the air pressure in their operators drops below a particular value.

All of the remotely-controlled valves illustrated in the FIGURE are shown in their normal state. The form in which the valves are illustrated is selected to permit easy understanding of their operation and is not intended to suggest any specific form of construction. Thus, each valve in the system can be a slide valve, ball valve, flap valve, etc.

Pump 20 has its inlet side connected to the supply outlet of a hydraulic fluid reservoir 19 and its outlet side connected to one side of valve 21. The other side of valve 21 is, in turn, connected to one side of valve 22 while the other side of the latter valve is connected to a line for returning hydraulic fluid to reservoir 19.

The conduit connected between valves 21 and 22 is also connected to a manually-operated shut-off valve 23 whose other side is connected to a series arrangement of a manually operated valve 25 and a relief valve 27 leading to the return line to reservoir 19.

The other side of valve 23 is further connected to a series arrangement of manually-operated valves 30 and 32 leading to the well system balance line. Valve 30 is an isolation valve which isolates the balance line from the pump output. The point of connection between valves 30 and 32 is connected, via a further manually-operated valve 36 and a relief valve 38, to the reservoir fluid return line.

The other side of valve 23 is also connected to the control line for the well system surface safety valve via a manually adjustable metering valve 40 connected in parallel with a high pressure check valve 42 arranged to permit fluid flow only in a direction away from the surface safety valve, and to the control line for the well system subsurface safety valve via a manually adjustable metering valve 44 connected in parallel with a check valve 46 arranged to permit fluid flow only in a direction toward the subsurface safety valve.

The system is completed by a hand pump 50 which can be used to manually operate the system in case of failure of the air supply, hydraulic pump, or valve 21 or 22, and under conditions which permit the safety devices to be bypassed. Also provided are several pressure gauges 52, 53 and 54 which help an operator to monitor the operation of the system.

To begin operation of the system, valve 1 is opened to conduct air under pressure from supply 2 to air regulator 3 which regulates the air pressure for the remaining portion of the pneumatic subsystem.

The regulated air is delivered to air-driven pump 20 which pumps hydraulic fluid out of reservoir 19. The air from regulator 3 is also supplied to one side of air operated valve 4 and one side of toggle valve 5, both of which are in their normal, closed, states during system start-up.

Then, to activate the system, valve 5 is manually opened, and held open, to supply the air pressure to metering valve 10 and through that valve to pressure gauge 52 and to the control input of valve 4, which is also connected to the input 6 for receiving pneumatic control signals from, for example, a pilot monitoring the pressure in the pipe conducting product from the well, or fusable plugs, gas monitoring equipment, etc. Any variety and number of specific devices can be connected to input 6 and these can be changed periodically as conditions at the well change.

As air flows through valve 10, the pressure in the section downstream thereof increases until reaching a level at which valve 4 is opened to provide a flow path parallel to that of valve 5, so that the latter can be permitted to close.

At the time that valve 5 is opened, air under pressure is also supplied through three-way valve 8 to the operator portions 21' and 22' of valves 21 and 22. A short time after opening of valve 5, the pressure at operators 21' and 22' will rise to a level at which valves 21 and 22 are actuated, so that valve 21 will open to open the hydraulic flow path from pump 20 and valve 22 will close to block return of the hydraulic fluid to the reservoir 19.

Under all normal operating conditions, manually activated valves 23 and 25 are open, so that upon opening of valve 21, the hydraulic pressure is transmitted via valves 23 and 40 to the surface safety valve, and via valves 23 and 44 to the subsurface safety valve.

To apply pressure to the balance line under normal conditions, valves 36 and 32 are opened and valve 30 is opened briefly, allowing the pressure in this line to reach a point that is determined by relief valve 38. Valve 38 is a preset relief valve. When this point is reached, valve 30 is closed.

Valves 40 and 44, being adjustable metering valves, are set to provide fluid flows required to operate the safety valves in the desired manner. In addition, upon opening of valve 21, hydraulic pressure fluid will flow through check valve 46 to the subsurface safety valve, but will not flow through valve 42 to the surface safety valve. Based on the setting of valves 40 and 42, and the flow of hydraulic pressure fluid through valve 46, there will be a higher volume flow to the subsurface safety valve so that this valve will open before the surface safety valve, which is the sequence desired so that the subsurface safety valve will not have to open against the full well pressure differential.

Relief valve 27 is set to open, to provide a return path to the reservoir, if the pressure in the line from valve 23 exceeds a predetermined value, while valve 38 is set to open if the pressure downstream of valve 30 exceeds the selected balance line pressure. Valve 38 allows for expansion in the balance line due to heating which occurs when the well starts to flow and thus prevents high pressure from developing in the balance line when such heating occurs.

Pressure gauge 54 indicates the presence of positive pressure in the balance line, while gauge 53 indicates the pressure being supplied to the safety valves and gauge 52 indicates the pneumatic pressure in the monitoring signal lines.

If, for any reason, a higher pressure is to be created in the balance line, valves 30 and 36 would be closed, valve 32 would be open, and hand pump 50 would be operated until the desired higher pressure had been reached.

Shutdown of the system, involving closing both safety valves, can be effected automatically in response to a shut-down signal from any one of the monitoring devices connected to input 6.

The pneumatic shut-down signal will be in the form of a pressure drop at input 6. This will reduce the pressure in the operator part 4' of valve 4 to a level at which the valve closes, valve 5 having previously been permitted to close at the end of the start-up phase.

Upon closing of valve 4, the supply of air under pressure to operators 21' and 22' is terminated and as soon as a sufficient quantity of air bleeds out of these operators, via valve 10, valves 21 and 22 close, blocking the hydraulic pressure transmission between pump 20 and the safety valves while providing a path, via valve 22, for flow of hydraulic fluid from the lines connected to the safety valves back to the fluid reservoir.

Pressure fluid can flow from the subsurface safety valve only via its associated metering valve 44, but can flow from the surface safety valve via both its associated metering valve 40 and its associated check valve 42. Therefore valve 44 can be easily adjusted to assure that hydraulic control fluid will flow from the surface valve more rapidly than from the subsurface valve so that the surface valve will close before the subsurface valve. This closing sequence provides additional protection for the subsurface valve by preventing it from closing against full well flow.

Whenever desired, closing of the surface and subsurface safety valves can be initiated manually simply by switching valve 8 to place its common port in communication with its normally closed port which communicates with a vent outlet, for example to the external atmosphere. This causes rapid venting of the air in operator parts 21' and 22' and thus rapid return of valves 21 and 22 to their normal states.

When it is desired to rely on hand pump 50 to provide the hydraulic pressure for opening the surface and subsurface safety valves, valves 23, 32 and 36 must be closed and valve 30 opened. Then pump 50 is operated to produce the necessary operational pressure, which can be monitored by gauge 53. With this mode of operation, the safety system is ineffective and no pressure is being applied to the balance line.

Valve 25 is provided to permit the application to the subsurface safety valve of a hydraulic pressure greater than that to which relief valve 27 is set. This may be necessary if the subsurface safety valve should experience a malfunction causing it to stick in its closed state.

When a shut-down, or shut-in, signal appears at input 6, this signal being in the form of a drop in the pressure in the conduit at input 6, it is of course desirable that the system respond with a high degree of reliability. In addition, it is usually desirable, if not essential, that a safety system respond rapidly. The present invention permits both of these goals to be realized in a particularly advantageous manner by providing an essentially direct fluid-transmitting connection, without any intermediate active devices between the operators 21' and 22' and signal input 6, as well as between operator 4' and input 6. This direct connection between the signal input and the operators of the valves whose operation directly determines the pressure of the fluid that operates the well safety valves results in a structurally simple arrangement. The directness of the connection permits achievement of a rapid system response and, in conjunction with its structural simplicity, establishes a high level of reliability.

Furthermore, the operating flexibility of the system according to the invention, and its ability to be adapted to varying operating conditions and requirements, are greatly enhanced by the provision of the adjustable variable-orifice metering valve 10 between input 6 and operator 4', on the one hand, and one side of the flow control portion of valve 4 and operators 21' and 22', on the other hand. The variability of the diameter of the flow passage, or orifice, of valve 10 permits a simple but accurate adjustment of the air flow between the flow path provided by valve 4 and the input to its operator 4'.

Upon receipt of a shut-in signal at input 6, the first phase of the system response is closing of valve 4. This requires bleeding of a certain quantity of air from valve operator 4'. In a preferred embodiment of the invention, valve 4 could be constituted by a commercially available model whose operator 4' has an internal volume of 0.6 cubic inches, so that only a small quantity of air would have to be bled off from operator 4' to effect closing of valve 4.

Upon closing of valve 4, and since toggle valve 5 was previously closed at the end of the starting phase of system operation, the supply of air under pressure to operators 21' and 22' is blocked. Each valve 21 and 22 could, in the preferred embodiment of the invention, be constituted by a commercially available model having an operator with an internal volume of about 1.6 cubic inches and the tubing between operators 21' and 22' and input 6 could be designed to have an internal volume of about 0.5 inches so that subsequent to closing of valve 4, less than 5 standard cubic inches of air would have to be vented in order to effect closing of valves 21 and 22, after which the surface and subsurface safety valves will close in the proper sequence.

Valve 10 and operator 4' constitute, in effect, an air system which is separately adjustable, by adjustment of valve 10, to vary the response and sensitivity of the entire safety system over a fairly wide range. In fact these elements can be considered to be the heart of the entire safety system.

If valve 10 is opened to its maximum flow passage diameter, the volume of air which must be vented off, after a pressure drop appears at input 6, would be a maximum, primarily because of the continuing flow of air under pressure through valve 4. For example, in the preferred embodiment of the invention, this might make it necessary to vent 20 standard cubic inches of air before valve 4 will close. This would constitute a setting of the system to its lowest sensitivity level.

Conversely, if valve 10 is adjusted almost to its closed position, it might only be necessary to vent 0.8 standard cubic inches of air, after a pressure drop appears at input 6, to effect closing of valve 4, and this would constitute a setting of the system to its highest sensitivity level.

While it might normally be desired for the system to be set to its highest sensitivity level, conditions will arise in the field which make it desirable that the sensitivity of the system be reduced. This can be accomplished simply by varying the setting of valve 10, without interrupting the operation of the system. If valve 10 were not adjustable, this sensitivity variation could be achieved only by shutting down the system and replacing the valve.

Moreover, use of a variable orifice valve in accordance with the present invention permits continual operation of the system at its high sensitivity setting while assuring that the integrity of the safety system will be reliably maintained. As mentioned above, the highest sensitivity setting corresponds to a minimum orifice size. By way of example, in a preferred embodiment of the invention, attainment of the desired high sensitivity level would require an orifice ¼ inch long and 1/80 inch in diameter. Such an orifice would be highly prone to plugging and a plugged orifice would prevent the system from being placed in operation, because pressure medium could not reach operator 4'.

In contrast, an adjustable valve is less prone to plugging and if plugging should occur, the valve need only be opened slightly to alleviate the condition while reestablishing the desired high sensitivity state.

An additional advantage of a variable orifice valve is that it permits the safety system to be rapidly and accurately adjusted, while maintaining the desired sensitivity, to any addition or removal of monitoring devices.

In order for the disclosed system to operate properly, the flow rate through that one of the connected monitoring devices which produces the lowest flow rate when actuated must be greater than the flow rate from regulator 3 through valve 10. The adjustability of valve 10 enables the system to be readily adapted to any change in the number or nature of the monitoring devices.

Furthermore, monitoring devices and the lines connecting them to input 6 are likely to present small leaks which must be compensated by the air flow through valve 10. As more monitoring devices are connected to a system, the chance that such leaks will occur, and the possible leakage flow rate, will increase. With a fixed orifice at the location of valve 10, it could easily occur that these leaks would produce a shut-in signal. The variable orifice valve according to the invention permits compensation for such leaks together with maintenance of the desired sensitivity.

The variable orifice valve 10 also permits the system to be easily adjusted to the decreases which occur in the flow rates of gases through small diameter lines at low temperatures, particularly the extremely low temperatures found in artic environments, such as on the Alaskan North Slope.

It is realized that decreasing the orifice size in valve 10 will result in a slower bleeding of the air in valve operators 21' and 22' during a shut-in signal. However, since the volume of air is less than 4 standard cubic inches in this system, the overall effect of a smaller orifice setting is negligible. This has been confirmed by actual field testing.

Proper operation of the system according to the invention is further aided by provision of regulator 3, and by connection of both the pump drive and operators 21' and 22' to the output side of the regulator. Since pump 20 generates an hydraulic output pressure which is proportional to the pneumatic drive pressure which it receives, and the operating force within valves 21 and 22 must correspond to the hydraulic pressure against which they must act, this connection assures that any increase in the pump output pressure will be accompanied by a corresponding increase in the operating forces applied by operators 21' and 22' to their respective valves 21 and 22. Thus the pressure to operators 21' and 22' is always proportional to the drive pressure supplied to pump 20 so that any increase in the pump hydraulic output pressure will automatically be accompanied by an increase in the valve operating forces valves 21 and 22.

In the preferred embodiment of the invention to which reference has already been made, regulator 3 could be a standard component capable of delivering 30 cubic feet of air per minute at a pressure of 0 to 100 psi. As mentioned earlier, the valves 4, 21 and 22 could be of types whose operators have internal volumes of 0.6, 1.6 and 1.6 cubic inches, respectively. In addition, valves 21 and 22 can each be of the type having a regulating type stem which causes the valve to switch in a manner to cause the pressure at the subsurface safety valve operator to change gradually to reduce the possibility of damaging that valve by sudden pressure pulse. Valve 10 could be constituted by any commercially available very fine metering valve having a suitable orifice variation range. Each of valves 21 and 22 should be of a type capable of handling up to 6,000 psi hydraulic pressure at their high pressure side. Valves 40 and 44 could each be a metering valve with a slightly higher $C_v$ factor than valve 10.

A $C_v$ factor is a flow rate number arrived at using the following flow formulas for liquids recommended by the Fluid Controls Institute, Inc.:

$$Q = C_v\sqrt{\frac{\Delta P}{SG}} \quad (1)$$

$$C_v = Q\sqrt{\frac{SG}{\Delta P}} \quad (2)$$

$$\Delta P = \frac{Q^2\,(SG)}{C_v^2} \quad (3)$$

where:

Q = Flow in U.S. gallons per minute;

ΔP = Pressure drop (PSI);

SG = Specific gravity of fluid (Water = 1.0); and $C_v$ = Valve flow coefficient. Relief valve 27 could be adjustable to open at a value between 2,000 and 5,000 psi, while relief valve 38 is preferably adjustable to a relief pressure value in the range between 20 and 100 psi.

Pump 20 could be similar to models manufactured by Haskell constituting a direct ratio pump having a hydraulic output pressure/pneumatic input pressure ratio of 50:1 to 100:1. In a system according to the invention, the pump could receive air at a pressure of 60 psi to pump oil at a pressure of 3,000 to 3,600 psi.

It will be understood that the above description of the present invention is susceptible to various modifications, changes and adaptations, and the same are intended to be comprehended within the meaning and range of equivalents of the appended claims.

What is claimed is:

1. In a safety system for closing a primary valve disposed in the flow path of a primary fluid, in response to an indication of an undesirable condition from a monitoring device, the opening and closing of the primary valve being controlled by the pressure of an operating fluid supplied thereto the system being composed of input means arranged to be connected to the monitoring device to receive therefrom an indication of the condition being monitored, output means arranged to supply operating fluid to the primary valve, valve means connected with the output means for controlling the pressure of the operating fluid at the output means, and fluid-responsive operator means having an input operatively associated with the input means for receiving a control fluid, the operator means being connected to the valve means for switching the valve means between a state which causes the pressure at the output to effectuate opening of the primary valve and a state which causes the pressure at the output to effectuate closing of the primary valve, the pressure of the control fluid at the operator means when an indication of an undesirable condition is present at the input means having a value which causes the operator means to switch the valve means into the state which causes the operating fluid pressure at the output means to effectuate closing of the primary valve, the improvement wherein: said system comprises conduit means connected to establish direct fluid communication between said operator means input and said input means, such that control fluid is present at said input means; the control fluid pressure at said input means is determined by the indication received from the monitoring device; said operator means are arranged to switch said valve means into the state which results in closing of the primary valve when the control fluid pressure at said operator means input corresponds to the control fluid pressure created at said input means when an indication of an undesirable condition is received from the monitoring device; said system further comprises a control fluid input for receiving control fluid under pressure; said valve means and operator means comprise a first valve having an associated operator and presenting a normally closed fluid passage, said operator being connected to said input means, one side of the fluid passage defined by said first valve being connected to said control fluid input, and the other side of said fluid passage being connected in said system for causing the pressure at said output means to effectuate closing of the primary valve when the fluid passage presented by said first valve is closed and opening of the primary valve when the fluid passage presented by said first valve is open; and said system further comprises an adjustable metering valve having one side connected to said other side of said fluid passage of said first valve and having its other side connected to said operator of said first valve.

* * * * *